United States Patent [19]

Koblo et al.

[11] 4,371,321

[45] Feb. 1, 1983

[54] METERING PUMP

[75] Inventors: Jochen Koblo; Stephan Schuck, both of Wiesbaden, Fed. Rep. of Germany

[73] Assignee: Hoechst Aktiengesellschaft, Frankfurt am Main, Fed. Rep. of Germany

[21] Appl. No.: 136,562

[22] Filed: Apr. 2, 1980

[30] Foreign Application Priority Data

Apr. 11, 1979 [DE] Fed. Rep. of Germany ..... 2914745

[51] Int. Cl.[3] ..... F04C 5/00; F04B 45/08

[52] U.S. Cl. ..... 418/45; 417/474

[58] Field of Search ..... 417/476, 474, 475, 319; 418/45, 63, 29

[56] References Cited

U.S. PATENT DOCUMENTS

| | | | |
|---|---|---|---|
| 2,251,235 | 7/1941 | Weydell . | |
| 2,332,157 | 10/1943 | Mapson | 418/45 |
| 2,414,355 | 1/1947 | Bogoslowsky | 418/45 |
| 2,898,859 | 8/1959 | Corneil | 418/45 |
| 3,687,580 | 8/1972 | Griffiths | 418/45 |

FOREIGN PATENT DOCUMENTS

| | | | |
|---|---|---|---|
| 2123194 | 10/1972 | Fed. Rep. of Germany | 417/477 |
| 848279 | 10/1939 | France . | |
| 2307990 | 11/1976 | France | 417/476 |
| 464396 | 6/1951 | Italy | 417/476 |
| 411582 | 11/1966 | Switzerland . | |

*Primary Examiner*—Richard E. Gluck

*Attorney, Agent, or Firm*—Schwartz, Jeffery, Schwaab, Mack, Blumenthal & Koch

[57] ABSTRACT

The invention relates to a metering pump for liquid and gaseous media, which is provided with a deformable tube for the medium to be conveyed. The pump casing accommodates a rotating member which squeezes the tube against an inside surface in the pump casing. The tube is guided around the rotating member constituting a main eccentric, through a looping angle of 360°. A secondary eccentric, the diameter of which is smaller than the diameter of the main eccentric, is mounted on the shaft of the main eccentric. The main eccentric is a ball bearing, the outer race of which clings to the tube by surface adhesion during rotation of the shaft. The ball bearing is rotated with the rotating shaft, while the outer race performs a radial reciprocating motion, thus avoiding any flexing of the tube, which is merely cyclically compressed and released again.

7 Claims, 3 Drawing Figures

METERING PUMP

BACKGROUND OF THE INVENTION

The present invention relates to a metering pump for liquid and gaseous media and more especially to a metering pump comprising a deformable tube for the medium to be conveyed, which is disposed in a pump casing and is squeezed against an inside surface in the pump casing by a rotating member.

Elastic tube pumps of this kind are primarily used to convey acid and alkaline media, in particular alkali metal hydroxide solutions and acids which may be in a liquid or gaseous state, abrasive materials and substances of different viscosities, particularly highly viscous substances. These elastic tube pumps act as self-aspirating metering pumps, without valves and seals, and they enable a reversal of the conveying direction by changing the direction of rotation of the driving motor.

In a prior art elastic tube pump, the tube is guided around an angle of 120° inside the pump, between its inlet and outlet side. Within the pump casing, three rollers are provided which force the tube against a plastic-coated inside surface of the casing. The content of the tube is thereby pressed in the conveying direction, according to the rotary motion of the rollers which are disposed at the corners of a rotating triangular-shaped body. Behind each roller a vacuum is produced which exerts a constant suction force upon the material to be conveyed so that the latter is automatically aspirated. For driving the pump, a reduction gear unit can be used, which is actuated by a motor via a V-belt drive. Furthermore, the pump can be coupled directly with a geared motor or it can be driven by a motor via an infinitely variable speed transmission.

In another known elastic tube pump, two rollers are disposed in the pump casing, one close to the inlet and the other close to the outlet of the pump. Both rotate counter-clockwise and are interconnected by struts. The two rollers lie on a common straight line and enclose an angle of 180°. When this arrangement rotates, one of the two rollers is always in contact with the inner wall of the tube, squeezing it together and producing a vacuum behind the roller so that the material to be conveyed is aspirated.

An elastic tube pump which is also known from the prior art is constructed similarly to the above pump. This pump is equipped with two rotating rollers which are arranged opposite to one another and alternatingly compress a tube, squeezing it against a concentric guide channel inside of the pump casing. Similar to the construction in a centrifugal governor, the rollers are attached by brackets to a rotating shaft which is driven from the outside. In this pump, as in the case of the aforementioned pump, the tube is guided around an angle of 180° inside the casing, between the inlet and the outlet side of the pump.

In reproduction technique, diaphragm pumps controlled via pulse generators have, up to now, been used as the primary means to convey a developing medium, for example, an ammonia solution. These pumps have the disadvantage that a surplus of ammonia developing solution is conveyed and introduced into the developing chamber, which surplus serves to bridge an interval between two successive pulses, for example 5 seconds. As a result, the material to be developed may, occasionally, be developed with too much moisture and may become patchy. It is further a disadvantage that the ammonia consumption is generally too high, i.e., it exceeds the quantity needed by about 30 to 40%. Of course, this surplus must be removed again from the developing chamber, and this is not only a time-consuming procedure, but requires also suitable measures to achieve absorption, in order to reduce the proportion of ammonia in the exhaust air. In addition, the surplus quantity collects in the pump body during the downtime of the pump, and this may lead to a failure of the pump.

The aforementioned known metering pumps which are based on elastic tube pumps have the disadvantage that the pump casing contains at least two rotating rollers or other rotating members which compress the tube and axially flex or stretch it at the same time, so that the service life of the tube is reduced and the tube must frequently be exchanged. Since the tube is compressed by at least two rotating members and the circumferential angle of the tube is maximally only 180°, a continuous conveyance is not ensured, because when changing from one rotating member to the next, a pulse of pressure is brought to bear upon the tube and, as a result, a slight unsteadiness in the uniform conveyance will always occur.

SUMMARY OF THE INVENTION

It is, therefore, an object of the present invention to provide an improved metering pump.

It is a further object of the invention to provide a self-aspirating elastic tube pump for metering a material to be conveyed, wherein the tube is compressed by a single rotating member in the interior of the pump casing.

Another object of the invention resides in providing an improved metering pump which operates without causing any axial flexing and wherein a continuous conveyance of the medium is possible.

In accomplishing the foregoing objects, there has been provided in accordance with the present invention a metering pump for a liquid or gaseous medium, comprising a generally cylindrical pump housing; a deformable tube for the medium to be conveyed, the tube being looped 360° around the inside surface of the housing; a shaft rotatably supported along the central axis of the housing; and a first rotating member eccentrically mounted on the shaft to constitute a first eccentric, this first eccentric having a maximum radius which is sufficient to squeeze the tube into a closed position against the inside surface of the housing. Preferably, the first eccentric comprises a ball bearing, having an outer race which clings to the tube by surface adhesion during rotation of the shaft, whereby the ball bearing is rotated together with the shaft, while the outer race performs a radial reciprocating motion. The preferred embodiment further comprises a housing cover on both ends of the cylindrical housing and a ball bearing arranged in each casing cover for supporting the shaft, as well as means, including a second eccentric on the shaft, the diameter of which being smaller than the diameter of the first eccentric, for mounting the first eccentric on the shaft so that tension is released against the tube when the shaft is stopped. Preferably, the second eccentric comprises a bearing, carried on the shaft, equipped with at least one cam which, during a rotation of the second eccentric comes into contact with and exerts pressure upon the inside surface of a chamber inside the first eccentric at several points and causes the first eccentric to radially reciprocate.

Further objects, features and advantages of the present invention will become apparent from the detailed description of preferred embodiments which follows, when considered together with the accompanying drawings.

DETAILED DESCRIPTION OF PREFERRED EMBODIMENTS

According to the invention, the rotating member in the pump casing is eccentrically mounted on a centrally supported shaft, thus constituting a main eccentric, and the tube is guided around the main eccentric through a looping angle of 360°.

In one embodiment of the invention, the main eccentric is a ball bearing, the outer race of which clings to the tube by surface adhesion during the rotation of the shaft. As the ball bearing is rotated together with the shaft, its outer race performs a radial reciprocating motion. This ensures that axial flexing or stretching of the tube does not occur; instead, the tube is just compressed and then released again. Since the tube is looped around the main eccentric through an angle of 360°, it is invariably in contact with the main eccentric over the entire circumference thereof so that the medium is continuously conveyed, without any interruption.

Figure 1:
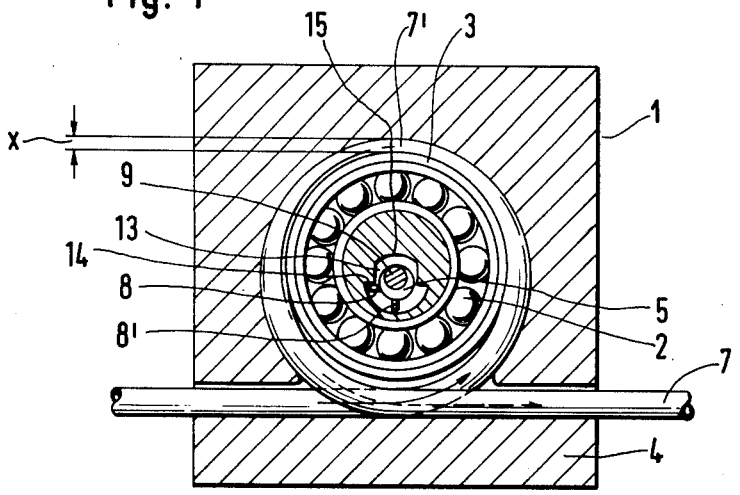
FIG. 1 is a diagrammatic sectional view of the metering pump according to the invention showing the tube in the released condition.

Turning now to the drawings, FIG. 1 is a sectional view of a pump 1, the pump casing 4 of which has in its interior a circular recess accommodating a tube 7. A drive shaft 9 passes through the center of this recess and is connected with a variable geared motor (not shown) which, for example, has a speed range from five to one hundred revolutions per minute, so that the pump 1 is capable of conveying quantities of an order of magnitude ranging from about 5 ml/h to 1000 ml/h. A main eccentric 2 which serves to compress the tube 7 is eccentrically mounted on the centrally supported shaft 9. This main eccentric 2 is a ball bearing around the outer race 3 of which the tube 7 is guided through a looping angle of 360°. Due to surface adhesion, the outer race 3 clings to the tube, and while the ball bearing rotates together with the rotating shaft 9, its outer race 3 instead moves radially with a back and forth motion, thereby compressing the tube over a large area in the zone of contact. As a result of the surface adhesion between the tube 7 and the outer race 3, the latter does not rotate and the tube 7 is thus not subjected to axial flexing, but is just squeezed together and released again. The tube 7 is looped around the main eccentric 2 in the counter-clockwise direction, and the direction of flow within the tube 7 is indicated by the arrows.

A secondary eccentric 5 is also mounted on the shaft 9 and is equipped with two cams 8 an 8′ which are arranged at a specific distance with respect to one another. The diameter of the secondary eccentric, which may, for example, be a needle or ball bearing, is approximately double the diameter of the shaft, but it is considerably smaller than the diameter of the main eccentric 2. The central part of the main eccentric 2 is provided with a chamber 13 which accommodates the secondary eccentric 5. The cross-section of this chamber 13 resembles a mushroom turned upside down, in diagrammatic representation. The chamber 13 has a surrounding shoulder 14 which is contacted by the cams 8 and 8′ when the secondary eccentric is rotated. The cams 8 and 8′ illustrated are equal in length, but they may also have different lengths.

Figure 2:
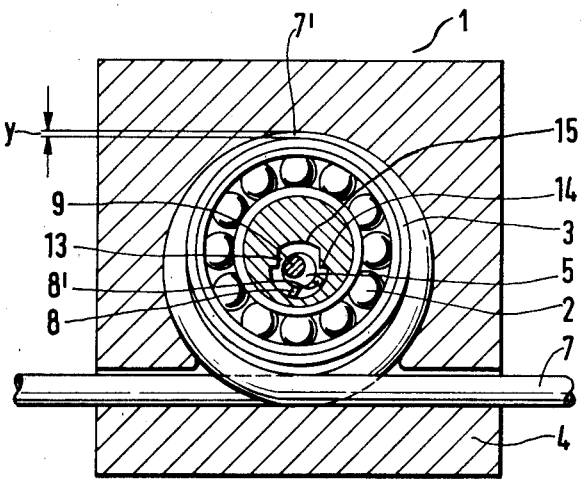
FIG. 2 is a sectional representation of the metering pump, similar to the view according to FIG. 1, but showing the tube in the loaded or squeezed condition.

In FIG. 1, the secondary eccentric 5 has adopted a position in which the cam 8 is in contact with the shoulder 14 on the left-hand side of the chamber 13, while the cam 8′ points vertically downwardly, leaving a gap with respect to the inside surface of the chamber 13. The tube 7 is then in the released condition and has a diameter x in its upper part. FIG. 2, which generally corresponds to FIG. 1, shows the secondary eccentric 5 in a position in which the cam 8 has been turned through a particular angle in the counter-clockwise direction, as compared with FIG. 1. The cam 8′ is short of contacting the shoulder 14 on the right-hand side of the chamber 13, while the cam 8 rests against the inner wall of the chamber 13 at a point which is approximately vertically below the shaft 9. The tube 7 is then compressed in its upper part and has, in the loaded condition, a diameter y which is smaller than the diameter x in the released condition.

Figure 3:
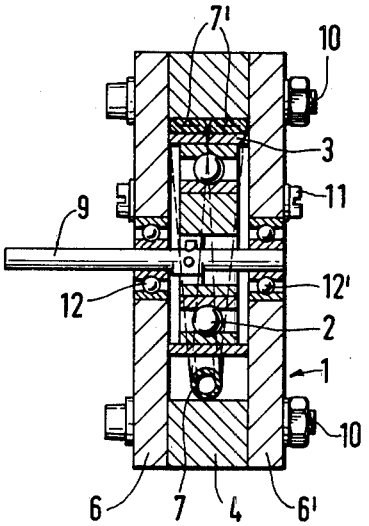
FIG. 3 is a lateral sectional view of the metering pump illustrated in FIGS. 1 and 2.

As is shown in the lateral sectional view according to FIG. 3, the pump casing 4 is closed on both sides by casing covers 6 and 6′ which are held together by screws 10. In the casing covers 6 and 6′, ball bearings 12 and 12′ are provided which serve to support the shaft 9. The main eccentric 2 is secured against dislocation by a fixing element, for example, a locking screw 11. In the upper part of FIG. 3, the loaded condition of the tube 7 is indicated by the reference numeral 7′, whereas the released tube in the lower part of the pump casing 4 is marked by the numeral 7. Although not shown, the secondary eccentric 5 may also have only one cam 8, which, during a rotation of the secondary eccentric 5, comes into contact with and exerts pressure upon the surface 15 of the chamber 13 at several points, thereby causing the main eccentric 2 to move radially back and forth, so as to squeeze the tube 7 together and release it again. In this manner, axial flexing of the tube does not occur, so that it will last considerably longer and can stand up to a service life of over one thousand hours and more. Since the tube 7 is disposed in the closed pump casing 4, the medium cannot escape in the case of a leak in the tube. By detaching the two screws 10, one of the two casing covers 6 and 6′ can be removed and the tube 7 is then accessible for exchanging.

By means of its single cam or its two cams 8 and 8′, the secondary eccentric 5 which is mounted on the shaft 9 engages the ball bearing or the central part of the main eccentric 2, respectively and, depending upon the eccentricity chosen, presses it more or less strongly against the inner side of the tube 7. The eccentricity of the main eccentric 2 is chosen according to the inside diameter of the tube 7 and, if possible, any tolerance occurring should not exceed ±0.1 mm. Due to the back pressure exerted by the tube 7, the latter is automatically released by the main eccentric 2, as soon as the shaft 9 is stopped, because owing to its eccentricity and as a result of the pressure existing in the tube, the main eccentric turns downwardly, until the cams 8 and 8' rest against the inside surface 15 of the chamber 13 and block any further downward movement. The tube 7 is thereby released and its diameter in the upper part of the recess is increased.

A trial application of a metering pump of this kind in the development of microfilms using ammonia dissolved in water, having, for example, a concentration of 25% $NH_4OH$, resulted in a considerable reduction of the ammonia consumption, compared with a conventional pulse-controlled diaphragm pump. Due to the continuous conveyance, a surplus of ammonia developer solution was not delivered, as in the case of the diaphragm pump which, as is known, must bridge an interval of 5 seconds between two pulses and will thus always inject a surplus of developing solution into the developing chamber.

The material of the elastic tube is preferably silicone rubber, but other resilient materials can also be used for the tube. The inner diameter of the tube is, for example, about 1 to 5 mm, the outer diameter about 3 to 10 mm. These values shall, however, not limit the scope of the invention which also includes tubes having inner and outer diameters exceeding the above-identified sizes.

What is claimed is:

1. A metering pump for a liquid or gaseous medium, comprising:

a generally cylindrical pump housing;

a deformable tube for the medium to be conveyed, said tube being looped 360° around the inside surface of said housing;

a shaft rotatably supported along the central axis of said housing;

a first rotating member eccentrically mounted on said shaft to constitute a first eccentric, said first eccentric having a maximum radius which is suffficient to compress said tube into a closed position against the inside surface of said housing; and means including a second eccentric on said shaft, the diameter of said second eccentric being smaller than the diameter of said first eccentric, for mounting said first eccentric on said shaft so that compression is automatically released against said tube at the point of maximum radius of said first eccentric in response to stopping of said shaft, wherein said first eccentric includes a chamber therein and said second eccentric is located within said chamber.

2. A metering pump as claimed in claim 1, wherein said first eccentric comprises a ball bearing, having an outer race which clings to said tube by surface adhesion during rotation of said shaft, whereby the ball bearing is rotated together with the shaft, while the outer race performs a radial reciprocating motion.

3. A metering pump as claimed in claim 2, further comprising a housing cover on both ends of said cylindrical housing and a ball bearing arranged in each casing cover for supporting said shaft.

4. A metering pump as claimed in claim 1, wherein said second eccentric comprises a bearing equipped with at least one cam which, during a rotation of said second eccentric comes into contact with and exerts pressure upon the inside surface of said chamber at several points and causes said first eccentric to radially reciprocate.

5. A metering pump as claimed in claim 4, wherein said second eccentric comprises two cams of equal length.

6. A metering pump as claimed in claim 4, wherein the bearing of said second eccentric comprises a ball bearing.

7. A metering pump as claimed in claim 5, wherein said chamber has a mushroom cross-section, having two shoulders which are contacted by said cams during rotation of said shaft.

* * * * *